US007810801B2

(12) United States Patent
Stemmer

(10) Patent No.: US 7,810,801 B2
(45) Date of Patent: Oct. 12, 2010

(54) APPARATUS AND METHOD FOR SEPARATING AND AERATING A STACK OF SHEET MATERIAL

(76) Inventor: Frank Stemmer, Babenhausen (DE)

( * ) Notice: Subject to any disclaimer, the term of this patent is extended or adjusted under 35 U.S.C. 154(b) by 353 days.

(21) Appl. No.: 11/999,563

(22) Filed: Dec. 6, 2007

(65) Prior Publication Data

US 2008/0136086 A1 Jun. 12, 2008

(30) Foreign Application Priority Data

Dec. 8, 2006 (EP) ..... 06025416

(51) Int. Cl.
*B65H 3/60* (2006.01)

(52) U.S. Cl. ..... 271/105; 271/146; 271/161

(58) Field of Classification Search ..... 271/146, 271/161, 105, 314
See application file for complete search history.

(56) References Cited

U.S. PATENT DOCUMENTS 3,460,826 A 8/1969 Porth
5,288,065 A * 2/1994 Wyssmuller ..... 271/105
2009/0108520 A1* 4/2009 Stemmer ..... 271/264

FOREIGN PATENT DOCUMENTS

DE 2641214 A1 5/1977
DE 3219696 A1 12/1983
DE 102004003455 A1 1/2004
EP 0021396 A1 1/1981

* cited by examiner

*Primary Examiner*—Kaitlin S Joerger
(74) *Attorney, Agent, or Firm*—Price, Heneveld, Cooper, DeWitt & Litton, LLP

(57) ABSTRACT

An apparatus and method for separating and aerating sheets of material arranged in a stack include a stack support member on which the stack is retained in a generally flat condition, and a clamping member which clamps onto an edge portion of the stack. Upper and lower rollers are positioned above and below the stack of sheet material, and an adjustment member converges and diverges the same into and out of engagement with the stack. A conveyor member shifts the stack of sheet material between the upper and lower rollers. The upper roller and lower roller are arranged in a staggered relationship, such that an imaginary plane extending between the two rollers is disposed at an angle with respect to both the horizontal and the vertical.

20 Claims, 7 Drawing Sheets

APPARATUS AND METHOD FOR SEPARATING AND AERATING A STACK OF SHEET MATERIAL

CLAIM OF PRIORITY

Applicant hereby claims the priority benefits under the provisions of 35 U.S.C. §119, basing said claim of priority on European Patent Application Serial No. 06 025 416.6, filed Dec. 8, 2006. In accordance with the provisions of 35 U.S.C. §119 and Rule 55(b), a certified copy of the above-listed European patent application will be filed before grant of a patent.

BACKGROUND OF THE INVENTION

The present invention relates to an apparatus and method for separating and aerating a material stack formed of sheets, such as a stack of paper or the like.

A device and a method for separating and aerating a stack of material formed of sheets, such as a stack of paper, is known from DE 10 2004 003 455 A1. The device has a clamping device arranged in the transport path of the material stack, which is referred to as a "stack" for short in the following for the sake of simplicity. The clamping device has a pair of rollers with an upper and a lower rotating roller. Another component of the device is also a mechanism for adjustment of the rollers with respect to each other, in order to bring them into active connection with the stack for forming a clamping area of the stack between the two rollers. The device also has a stack support or board for horizontally holding the stack, as well as a member for guiding the stack in the area between the open roller pair, and for guiding the stack clamped between the rollers. In this device, the stack lying on the board is gripped by tongs, and then pulled with a horizontal movement component, whereby the clamping device acts on the pulled stack.

In such prior art devices, the rollers are arranged in exact vertical alignment, or on top of each other. In this way, the connecting planes between the two bearing axles of the rollers are arranged vertically. Between the clamping device designed in this way and the board for holding the stack, another rotating roller is arranged that has a rotary axle parallel to the rotary axles of the rollers of the clamping device. This third roller has the function of an intake roller, in front of which the stack that is guided away from the board, and is held by the tongs in the area of its front end and deflected diagonally downward on a significantly lower level than the upper edge of the additional roller between the two rollers of the clamping device. The third roller thus also has the function of a bending roller. Because of that, the stack has a wavy shape between the bending roller and the clamping device. The two rollers of the clamping device turn in opposite rotational directions while the stack is guided by the tongs, and support the sliding process of the stack, because of the double deflection. When the tongs are pulled forward, the sheets, especially the lower sheets, of the stack hang downward between the tongs and the clamping device. This described separating process makes possible the entry of air between the individual sheets. This separating process can be supported or enhanced by air nozzles arranged to direct air laterally into the stack.

Such prior art devices are very complicated in construction because of the need to provide the other roller and the large vertical traversing path, at least of the upper roller of the clamping device, in order to reach the clamping position. Besides this, the tongs are not driven only horizontally, but also vertically to a considerable extent. In sum, the device requires a complicated design because of the geometric specifications described. Also, the process sequence is complex because of the two-fold deflection of the stack in the area of the clamping device and the named other roller.

DE 26 41 214 C3 discloses a device for loosening a stack of sheets, in which the stack is moved between a clamping device that has rollers arranged on top of each other, whereby the connecting plane of the bearing axles of the rollers is arranged vertically. A wide roller is arranged on the bottom, and on top, the driven roller has a ring zone in its center offset to a smaller diameter. The lower roller consists, at least in the area of the outer shroud, of a compressible material, such as rubber elastic. While the stack runs through the roller pair, the lower roller is deformed elastically, with the formation of an indentation, and the stack is pulled around the upper roller at a specific angle. Because of this motion, there is a shift of the sheets lying on the upper side of the stack with respect to the sheets lying on the underside of the stack.

DE 32 19 693 A1 discloses a device and a method for separating and aerating a stack of material formed of sheets. A rotating lower belt and a rotating upper belt are provided, wherein the circumferential speed of the lower belt is slightly higher than the circumferential speed of the upper belt. The stack to be separated is supported on a horizontally arranged upper section of the lower belt, and guided in the direction of the lower section of the upper belt to where the belt sections of the upper and lower belts run parallel to each other and are at a distance that is matched with the thickness of the stack and diagonally downward with respect to the horizontal. Two rollers are arranged where the stack runs into the belt sections, and are contacted on the top and the bottom, whereby a lower roller is pressed from below against the upper section of the lower belt, and an upper roller is pressed from above against the lower section of the upper belt. The stack is guided between the belt sections of the two belts, which are arranged so they are angled or tilted. Because of the speed difference between the two belts, the lower sheets are pulled away faster than the upper sheets of the stack. Because the stack bends over the lower roller in the intake area of the stack, there is a certain separating of the partial stack due to the guiding of the sheets of the stack at different speeds. The separating continues along the belt sections of the upper and lower belts. The two rollers in the intake area of the stack are arranged in such a way that the connecting plane of the two bearing axles of the rollers is arranged at an angle with respect to the horizontal and the vertical. This angle is perpendicular to the parallel guiding sections of the two belts. Consequently, this device is complicated, and is based on a special function principle, namely, that the contacting of the stack is by upper and lower belts, and the rollers do not come directly into contact with the stack. In addition, the supply and the removal of the stack occur on a flat board according to the deflection geometry of the lower belt, whereby in the intake area, the belt is horizontally oriented, and in the outlet area, it is tilted with respect to the horizontal between the two belts according to the slope of the belts.

SUMMARY OF THE INVENTION

One object of the present invention is a device that is designed especially simply in construction, and ensures outstanding separation and aeration of the stack with essentially horizontal guiding of the stack. Another object of the invention is also a method that makes possible a simple separation and aeration of the stack with essentially horizontal guiding of the stack, particularly to achieve automatic separation and aeration of the stack.

In one embodiment of the present invention, the connection plane between the two bearing axles of the rollers is arranged at an angle with respect to the horizontal and the vertical. The subject invention thus has only two rollers, which since the connecting plane of the two bearing axle shafts is arranged at an angle with respect to the horizontal and to the vertical, thus diagonally to it, can produce the separating process with the consequence that air can get between the separated sheets of the stack. Since the stack lies horizontally on the board, and is thus horizontally supplied, this arrangement of the clamping device at the named angle is sufficient to achieve a deformation of the stack and thus the fanning of the stack. The board itself is preferably designed as a table that can be stationary or traveling. The table can especially be driven exclusively horizontally. Since with the device, only one clamping roller pair is necessary, it is considered especially advantageous if the lower roller is arranged adjacent to the board in such a way that the stack is guided directly from the board to the lower roller. Thus, it is not necessary to supply the stack using auxiliary rollers, since the clamping device, which is arranged diagonally, provides the relevant separation and aeration function.

Basically, it would also be conceivable to consider the remaining stack, on which the material stack to be taken off rests, as the board. This remaining stack can be arranged in a lift and can be driven horizontally to an optimal height for removing from the partial stack.

According to one embodiment of the invention, the lower roller and the board are arranged so that they can be driven horizontally and/or vertically with respect to each other. A movement in both directions is conceivable, thus to the front and to the back, as well as upward and downward. Another method of operation of the device is that different stack thicknesses can be achieved, especially because of this driving capability.

Preferably, the diameter of the lower roller is larger than the diameter of the upper roller. Thus, a larger deformation of the stack results in the area of the upper roller in comparison to the deformation of the stack in the area of the lower roller. It can also be advantageous to design the rollers so they are elastic in the area of their rotating surfaces.

The upper and/or the lower roller may be mounted in an adjusting mechanism, such as pneumatic or electrical adjusting devices. Because of this, a driving capability of the upper and/or lower roller can be achieved in a manner that is simple in construction. Also, both rollers can be mounted so that they rotate freely. Driving the upper and/or lower roller is also conceivable. In any case, upon contact with the stack, the rollers run in opposite directions so that one roller runs clockwise and the other roller runs counterclockwise. Driving one roller and braking the other roller are also conceivable. By different rotary forces introduced on the rollers, the degree of separation and/or fanning of the stack can be changed, especially in the sense of an increase.

In one embodiment of the present invention, the connecting plane of the two bearing axles of the rollers is arranged at an angle of 30 to 60 degrees, preferably 40 to 50 degrees and especially 45 degrees, with respect to the horizontal. This orientation of the connecting plane thus definitely deviates from the horizontal or vertical. The angle of slope of the connecting plane can preferably be adjusted.

According to one embodiment of the present invention, the top of the lower roller is arranged at the height level of the contact surface for the stack, or the top is arranged at a height level that corresponds maximally to the dimension of the radius of the lower roller below the contact surface for the stack. Both variations make possible the conveyance of the stack essentially in a horizontal direction. If the top of the lower roller is arranged at least at the height level of the contact surface for the stack, there is no bending of the stack slightly downward between the board and the lower roller. Rather, the stack is deflected slightly upward, because the upper roller is arranged behind the lower roller, starting from the level of the contact surface of the board, in order to be deflected back slightly downward in front of the lower roller. Naturally, the option exists of lifting the lower roller over the height level of the contact surface for the stack. However, a significant lifting over this level is not necessary. On the other hand, the option exists of lowering the lower roller below the height level of the contact surface for the stack on the board, whereby it is only necessary to provide a maximum drop below this level that is relatively small to achieve the purpose according to the invention. This corresponds maximally to the dimension of the radius of the lower roller, which is especially advantageous if the stack rests on a traveling table that is driven over the roller, so as to grip the stack by tongs, and then drive the table back far enough so that the stack contacts the top of the lower roller, without the roller having to be driven upward vertically. Because of this arrangement, a very simple construction results. All that is necessary is to lower the upper roller to the stack lying on the lower roller for the purpose of clamping the stack between the two rollers.

It is also considered advantageous if the contact surface/contact plane of the stack on the board and the connecting plane of the two rollers, with stack clamped between the rollers, intersect between the rollers. The dimensioning basis is also expressed in that it is an intention of one aspect of the invention to convey the stack essentially horizontally during separation and aeration. The connecting plane of the two bearing axles of the rollers is especially oriented from the lower front to the upper back. The stack first deflects around the upper roller and then the lower roller.

One mechanism for conveying the stack contacts and slides the stack in the area between the open rollers, such as by using traveling tongs. The mechanism for conveying the stack in the area between the open rollers and/or for conveying the stack clamped between the rollers can be designed as traveling tongs that grip the stack in the front. It is especially conceived that the tongs can move horizontally, especially when the tongs have a stationary lower tong retainer, with respect to the tongs, and an upper tong retainer that can be driven relative to the lower tong retainer.

Another object of the invention is a method, wherein the rollers are oriented in such a way that the stack is pulled by the clamping device at an angle with respect to the horizontal and an angle with respect to the vertical. The bending of the stack occurs shortly before and shortly after the clamping device. Ideally, the horizontal supply and removal of the stack occur in the rear and front areas following the bent areas.

In one embodiment of the process, the board holding the stack is arranged adjacent to tongs, such that the sliding of the stack on the board occurs in the tongs, and the gripping of the stack occurs by means of the tongs. A slot is formed between the tong and the board when the tong and board are shifted apart, whereby the stack is placed on the lower roller, such that the clamping of the stack occurs by the clamping device in the area of the slot, and then the stack is pulled through the clamping device.

Other characteristics of the invention are shown in the sub-claims, the description of the figures and the figures themselves, whereby it should be noted that all individual characteristics and all combinations of individual characteristics represent other inventive designs.

These and other advantages of the invention will be further understood and appreciated by those skilled in the art by reference to the following written specification, claims and appended drawings.

BRIEF DESCRIPTION OF THE DRAWINGS

The invention is explained in more detail below using three exemplary embodiments with reference to the drawings. In the drawings.

DETAILED DESCRIPTION OF THE PREFERRED EMBODIMENTS

Figure 1:
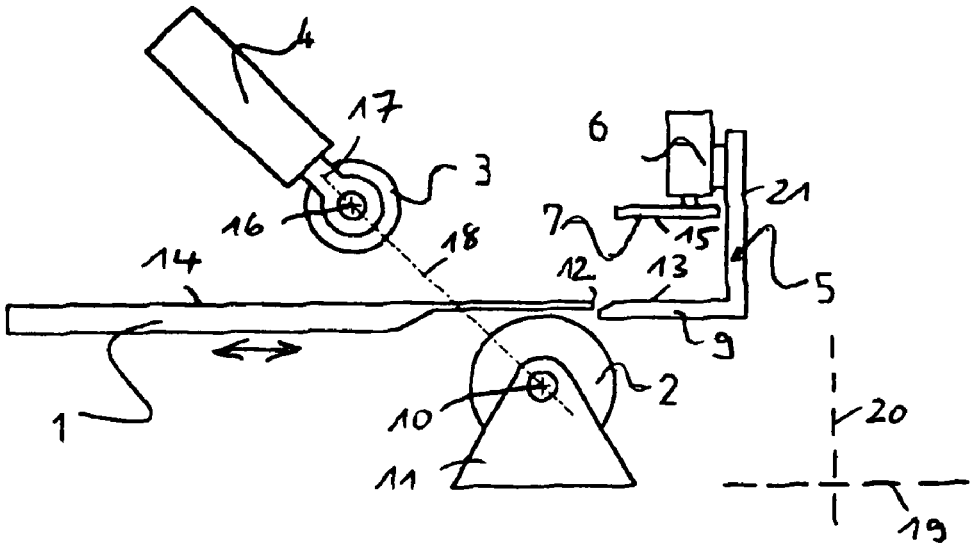
FIG. 1 shows a first embodiment of the device in schematic representation in a side view.

In the sense of the following description of the invention, it is assumed that the terms "top," "bottom," "front," "back," "forward" and "backward" relate to the orientation and the method of operation of the device during its use.

This means that "front" indicates the area of the device that is reached first during the guiding of the material stack and as a result, the term "back" relates to the area of the device that is subsequently reached by the material stack to be guided. The terms "forward" and "backward" are to be understood under consideration of this.

It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As significant components of the illustrated device, all embodiments shown have a table 1, a lower roller 2, an upper roller 3, a drive 4 for the upper roller 3, a clamp or tongs 5, a drive 6 for an upper part 7 of tongs 5, a lower part 9 of tongs 5 and a stack 8 formed of a plurality of sheets. These sheets involve, for example, sheets of paper, plastic film or the like.

Generally, a total stack is formed, from which a partial stack is taken off the top of stack 8 so that a remaining stack is left. The (partial) stack 8 is supplied to the device and separated and aerated there and then supplied to further processing, especially cut into a number of smaller partial stacks, especially by cutting the stack longitudinally and transversely by means of a guillotine-type cutter. Then another (partial) stack 8 is taken from the remaining stack, and it is also separated and aerated, etc., until the entire stack has been processed.

The individual embodiments of the invention are explained as follows.

In the first embodiment (FIGS. 1-5), the table 1 can be driven back and forth horizontally in the directions of the double arrows from an initial position, and has a front area with a reduced thickness above the lower roller 3, which is mounted in a frame 11 so it can rotate freely around a stationary axle 10. Tongs 5 are positioned directly adjacent to the front end 12 of the table 1, whereby it is sufficient that the tongs 5 can be driven exclusively horizontally. The gripping surface 13 of the lower jaw or part 9 of tongs 5 and the holding surface 14 of table 1 that forms the board for the stack 8 are preferably located at the same height level. In FIG. 1, tongs 5 are shown in the fully open state. In this case, the tong upper part 7 is lifted by means of the pneumatic drive 6. The gripping surface of the upper part 7 of the tongs 5 is designated by the reference number 15.

The lower roller 2 is arranged at a slight distance from table 1 in the area of its narrowed front end below this section of the table 1. When observed from above the front section of table 1, table 1 covers the greatest part of the lower roller 2, and the tong lower part 9 covers a small remaining area of the lower roller 2.

The upper roller 3 can rotate freely around the axis or axle 16. This axle 16 is mounted in the area of the two ends extending from the upper roller 3 in piston rods 17 of pneumatic cylinders, which represent the drive 4 of the upper roller 3. The imaginary connecting plane of the two axles 10 and 16 of rollers 2 and 3 that runs vertically through the sheet plane shown in FIG. 1 is indicated by the dotted line 18. This line and/or plane 18 runs at an angle to both the horizontal line 19 and the vertical line 20 shown in FIG. 1, wherein the horizontal line is parallel to the horizontal plane that runs perpendicular to the sheet plane through this line according to FIG. 1, and the vertical line is parallel to the line through which the vertical plane runs perpendicular to the sheet plane. In the illustrated example, the line 18 that connects the axles 10 and 16 of the two rollers 2 and 3 runs at an angle of 45 degrees with respect to horizontal line 19 and 45 degrees to the vertical line 20, respectively. The orientation of line 18 is such that it runs from the lower front to the upper back, with the upper roller 3 arranged behind the lower roller 2 in a staggered vertical relationship.

FIGS. 2 to 5 show the operating method of the device described in FIG. 1.

Figure 2:
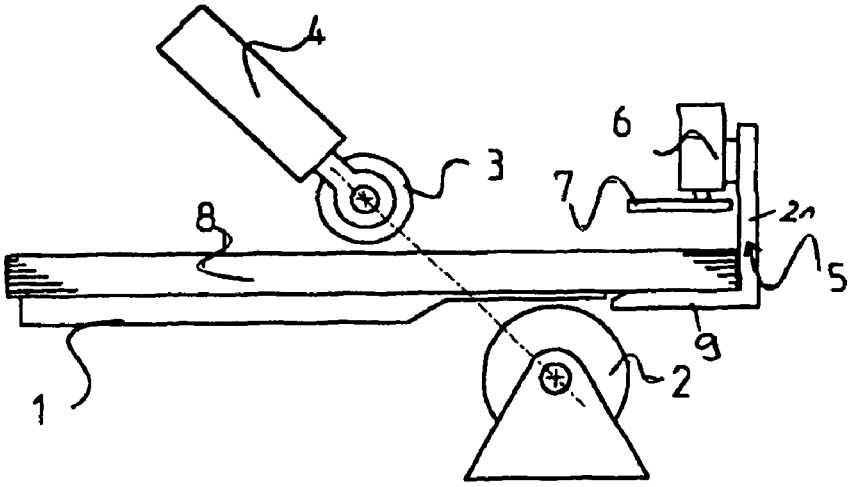
FIGS. 2 to 5 show process sequences of the device shown in FIG. 1 to illustrate the separation and aeration of a stack formed of sheets.

Starting from the state shown in FIG. 1, i.e., without conveyed stack 8, the stack 8 is slid by way of means that are not shown in more detail, e.g., a pusher, on table 1 and slid far enough so that the front vertical edge of the rectangular stack 8 contacts the vertical leg 21 of tongs 5, as shown in FIG. 2. The piston rods 17 of drive 4 of the upper roller 3 are fully retracted or driven in, so that the upper roller 3 is arranged at the maximum distance from the lower roller 2, as shown in FIG. 2.

Figure 3:
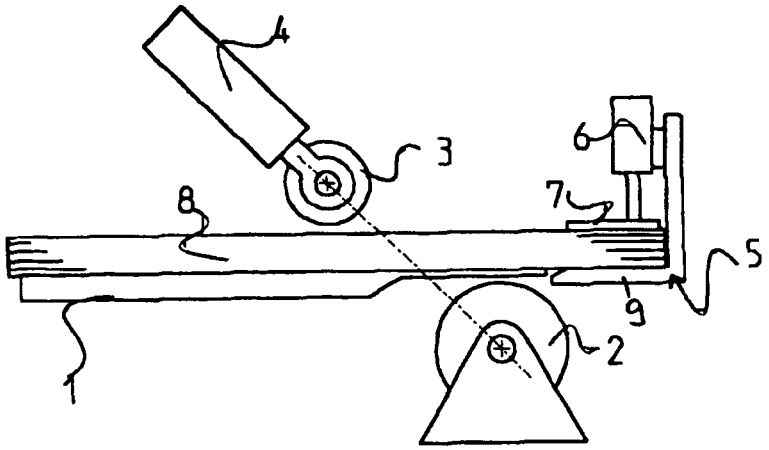

Then, by actuating the drive 6 of tongs 5, the tong upper part 7 is lowered so that the front end of the stack 8 is clamped securely between tong upper part 7 and tong lower part 9. This state is shown in FIG. 3.

Figure 4:
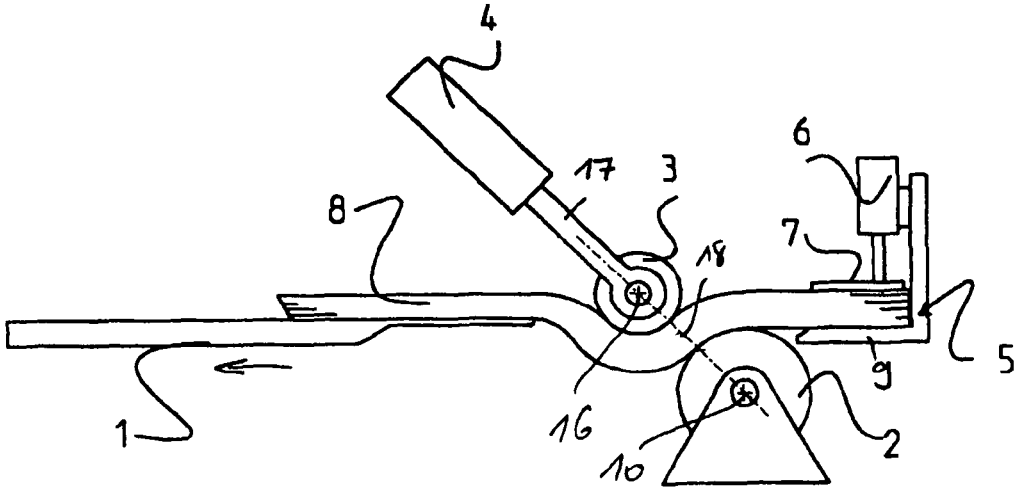

Next, the table 1 is driven or shifted back by a specific distance in the direction of the arrow shown in FIG. 4, so about the rear third of the stack 8 remains in contact with the table 1. Then, by means of drive 4, the piston rods 17 are extended or driven out, whereby the upper roller 3 is moved abuttingly against the stack 8. As a result, the stack 8 is clamped firmly between the upper roller 3 and the lower roller 2. As a consequence, the stack 8 deforms along its center, with the front and rear ends of stack 8 remaining located on the same level as before. Stack 8 is curved first in one direction along upper roller 3, and then in the opposite direction along lower roller 2. Since the front edge of the stack 8 is held clamped by tongs 5, the result is that a fanned arrangement for the back end of the stack 8 is created, as can be seen in FIG. 4. Because of the different diameters of rollers 2 and 3, the stack 8 is curved differently in the area of the rollers 2 and 3, particularly more in the area of the smaller upper roller 3 than in the area of the larger lower roller 2. The previously described state is shown in FIG. 4.

Figure 5:
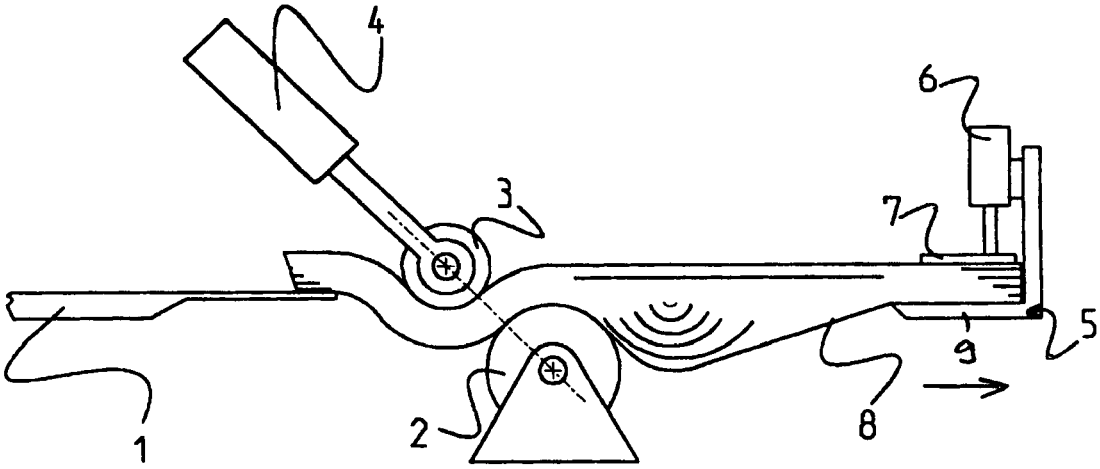

Finally, with the position of table 1 unchanged, as well as rollers 2 and 3, the tongs 5 are pulled forward horizontally in the direction of the arrow shown in FIG. 5, with the front edge of stack 8 remaining clamped in tongs 5.

In this part of the process, the stack 8 is continuously bent in the clamping area formed between the two rollers 2 and 3, starting in the area of the front half of stack 8 and ending at the back end of stack 8. That area of stack 8 that has already passed the lower roller and is thus located in front of the lower roller, and is held exclusively between the roller clamping area and the tongs 5, with the result being that because of the weight of stack 8, the sheets in this stack area sag significantly, which leads to further fanning and aeration of the stack 8. In addition, air nozzles can be arranged on the sides of the stack, which thus inject or insufflate air between the individual fanned sheet layers. Tongs 5 pull the stack 8 out of the clamping area between rollers 2 and 3 and lay it on a vibrating table or the like, as known from the state of the art, or another board that is not shown. The vibrating may be located, for example, directly below tongs 5, in the position of tongs 5 driven partially forward in FIG. 5.

Because of the fact that the stack 8 is pulled essentially horizontally through the device, a great deflection and/or curling of the stack is prevented. Stack 8 drives both the upper roller 3 and the lower roller 2 using frictional contact. Because of the different contact angles of rollers 2 and 3, different friction forces are transferred from the stack 8 to rollers 2 and 3, resulting in a relative movement of the individual sheets of the stack 8 and thus causing their separation or peeling.

Special effects can be achieved in a simple manner if one or both rollers are driven and/or one roller is braked. If due to such external influence, the circumferential speed of the upper roller 3 becomes less than that of the lower roller 2, this leads to a larger convexity of the stack 8 that hangs downward between lower roller 2 and tongs 5, whereby the stack 8 is especially greatly fanned.

Figure 6:
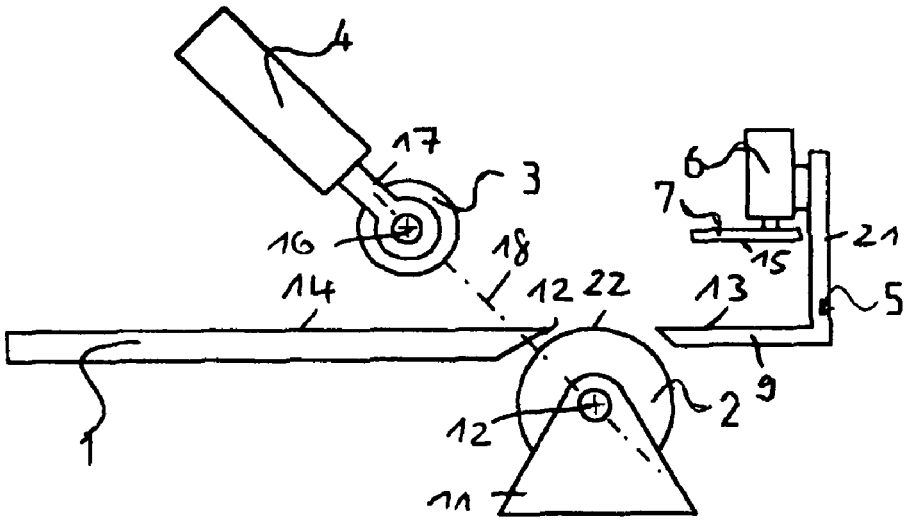
FIG. 6 shows a second embodiment of the device in schematic representation in a side view.

The device according to the embodiment in FIG. 6 is modified in comparison to the one according to the embodiment in FIG. 1, wherein the table 1 does not extend with its front end 12 far beyond the lower roller 2. Rather, it just barely extends to the rear end of the tong lower part 9. The front end 12 of the table 1 ends at about the same distance from the lower roller 2 as the back end of the tong lower part 9. Besides that, the upper surface 22 of the lower roller 2 is disposed parallel with the gripping surface 13 of tongs 5 and the holding surface 14 of the table 1. Other than that, the structure of this device is generally similar to the embodiment according to FIG. 1. Because of this, reference is made to the description above.

Figure 7:
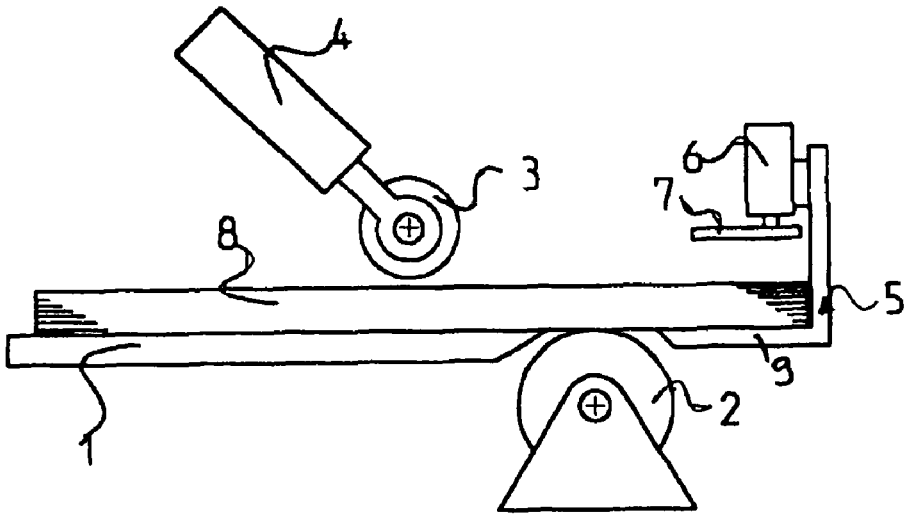
FIGS. 7 to 10 show process sequences of the device shown in FIG. 6 to illustrate the separation and aeration of a stack formed of sheets.
Figure 8:
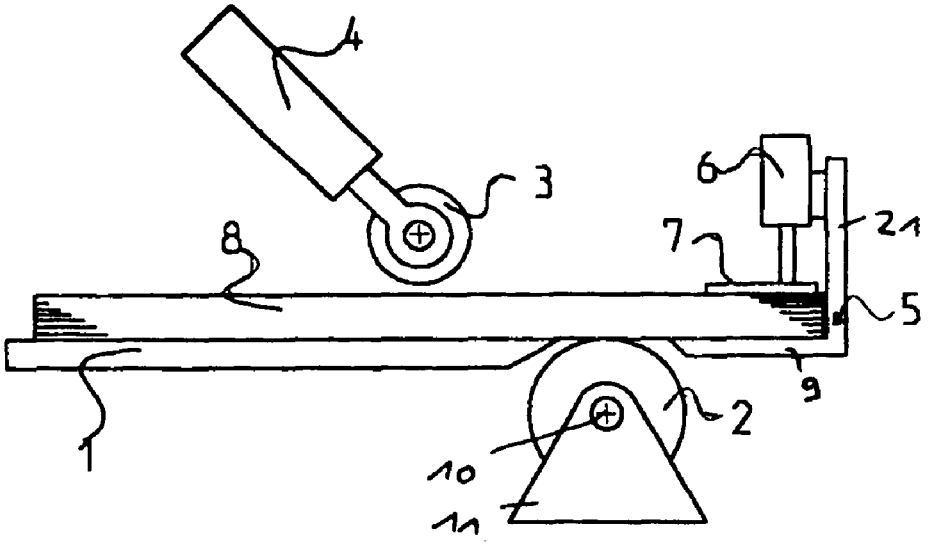

According to the process step as shown for the first embodiment of FIG. 2, in the second embodiment, the stack 8 is positioned over the table 1 against the vertical leg 21 of open tongs 5. This results in the state according to FIG. 7 in which, in contrast to the state according to FIG. 2 of the first embodiment, the stack 8 also lies on or abuts the lower roller 2. In the second embodiment tongs 5 are then closed to clamp the edge of stack 8, as can be seen in FIG. 8.

Then, the lower roller 2 and tongs 5 are driven upward together by a distance that corresponds to about half the radius of the lower roller 2, with table 1 driven back slightly simultaneously so the roller 2 driving upward does not collide with the front end 12 of the table. Then, or also simultaneously, the drive 4 is activated, and the upper roller 3 is driven in the direction of the lower roller 2, so the stack 8 is clamped between rollers 2 and 3. Because of this clamping action, the stack 8 is separated or fanned due to the fact that it is clamped in the area of tongs 5 at its front edge and is deflected in the same direction in the area of rollers 2 and 3. This state is shown in FIG. 9.

Figure 10:
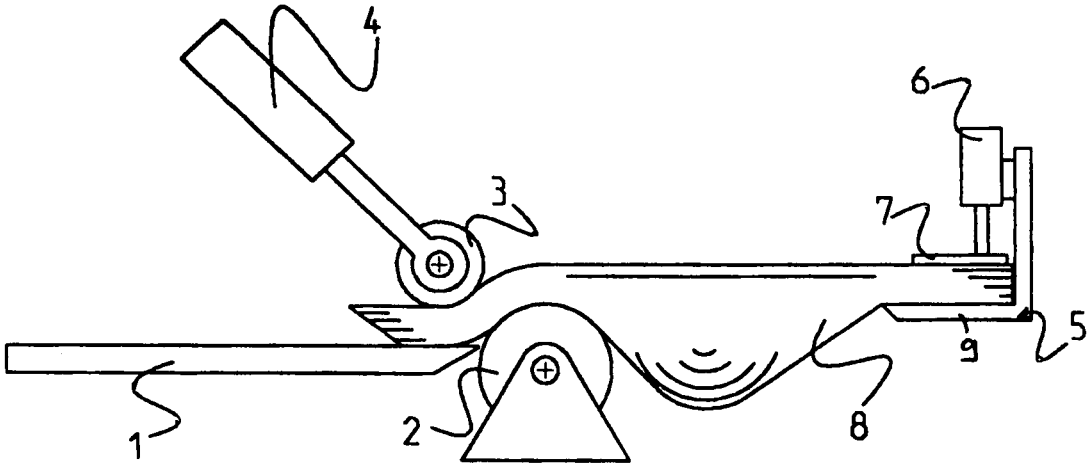

Then, with the two rollers 2, 3 and table 1 remaining in place, the somewhat raised tongs 5 are moved forward horizontally, whereby like the process steps shown in FIG. 5 of the first embodiment, the stack 8 becomes convex between the lower roller 2 and tongs 5, with the upper sheet layer tensioned horizontally. This state is shown in FIG. 10. Then, the stack is placed on a board, such as a vibrating table, in the manner previously described.

Figure 9:
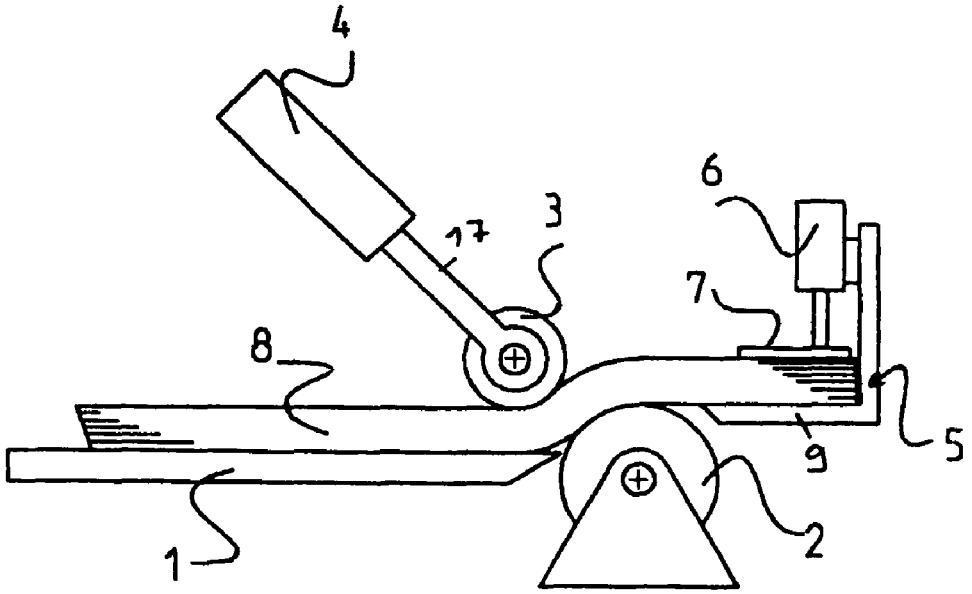
Figure 11:
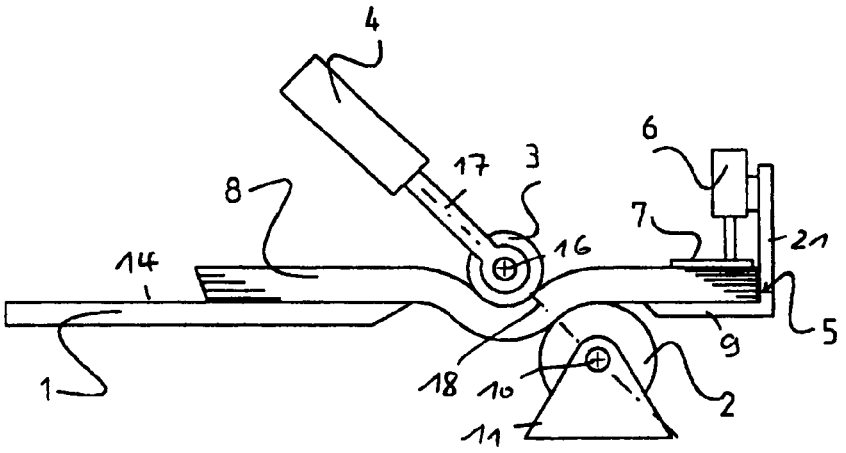
FIGS. 11 and 12 show a third embodiment modified in comparison to the second embodiment with process steps that correspond to the process steps according to FIGS. 9 and 10.
Figure 12:
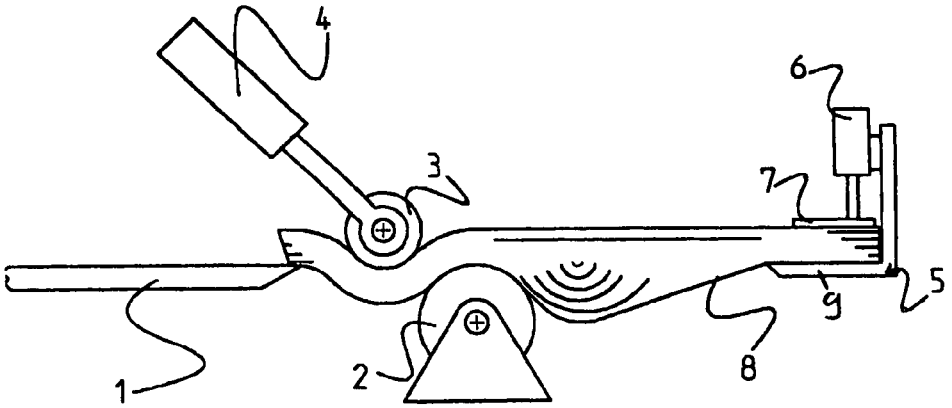

FIGS. 11 and 12 show a modification of the process sequence in comparison to the process sequence that is shown for the second embodiment in FIGS. 9 and 10.

In the situation shown in FIG. 8, the lower roller 2 and the tongs 5 remain at the same level. On one side of the stack 8, the table 1 is driven further away from the lower roller 2. By means of drive 4, the upper roller 3 is driven in the direction of the lower roller 2, where the stack 8 is clamped between the two rollers 2 and 3. With stack 8 driven back, about one third of its length still lies on the table 1. Consequently, as can be seen from the state in FIG. 11, the stack 8 bends downward between table 1 and lower roller 2, thus creating a greater contact angle at the upper roller 3. Then, as can be seen in FIG. 12, the tongs 5 are driven forward, and the stack 8 is pulled through the clamping area formed by the two rollers 2 and 3, such that the stack 8 is deformed between the lower roller 2 and the table 1 because of the effect of the upper roller 3, and also between the lower roller 2 and the tongs 5. As previously described, the special convexity of the stack 8 downward can be noted between lower roller 2 and tongs 5, while the upper sheet layers of stack 8 remain essentially horizontal.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An apparatus for separating and aerating sheets of material arranged in a stack, comprising:

a stack support member configured to abuttingly support thereon a stack of sheet material in a generally flat condition;

a clamping member configured to clamp onto an edge portion of the stack of sheet material and selectively retain the sheets in an aligned condition along the clamped edge;

an upper roller positioned generally above the stack of sheet material supported on said stack support member and having a first axis of rotation;

a lower roller positioned generally below the stack of sheet material supported on said stack support member and having a second axis of rotation;

an adjustment member configured to converge and diverge said upper roller and said lower roller into and out of selective engagement with the stack of sheet material supported on said stack support member;

a conveyor member selectively shifting said clamping member and the stack of sheet material clamped therein generally horizontally between and relative to said upper roller and said lower roller; and wherein said upper roller and said lower roller are arranged in a staggered relationship such that an imaginary plane extending between said first and second axes of rotation of said upper roller and said lower roller is disposed at an angle with respect to both the horizontal and the vertical.

2. An apparatus as set forth in claim 1, wherein:

said stack support member comprises a stationary table.

3. An apparatus as set forth in claim 2, wherein:

said lower roller is disposed adjacent to said table, such that the stack of sheet material is conveyed directly from said table to said lower roller.

4. An apparatus as set forth in claim 3, wherein:

said lower roller has an uppermost surface disposed generally level with an upper surface of said stack support member.

5. An apparatus as set forth in claim 4, wherein:

said upper surface of said stack support member and said imaginary plane intersect between said upper roller and said lower roller when the stack of sheet material is nipped between said upper roller and said lower roller.

6. An apparatus as set forth in claim 5, wherein:

said lower roller and said table are movable both horizontally and vertically relative to each other.

7. An apparatus as set forth in claim 6, wherein:

said lower roller has a diameter greater than the diameter of said upper roller.

8. An apparatus as set forth in claim 7, wherein:

said adjustment member includes either a pneumatic motor or an electrical motor.

9. An apparatus as set forth in claim 8, wherein:

at least one of said upper roller and said lower roller is free rotating.

10. An apparatus as set forth in claim 9, wherein:

at least one of said upper roller and said lower roller is driven, and the other of said upper and said lower roller is braked.

11. An apparatus as set forth in claim 10, wherein:

said imaginary plane is arranged at an angle in the range of 30 to 60 degrees with respect to the horizontal.

12. An apparatus as set forth in claim 11, wherein:

the slope angle of said imaginary plane is adjustable.

13. An apparatus as set forth in claim 12, wherein:

said imaginary plane is oriented from the lower front to the upper back.

14. An apparatus as set forth in claim 13, wherein:

said conveying member is disposed between said upper and lower rollers, and shifts said clamping member.

15. An apparatus as set forth in claim 13, wherein:

said conveyor member is disposed between said upper roller and said lower roller, and translates said clamping member attached to the front edge of the stack of sheet material.

16. An apparatus as set forth in claim 14, wherein:

said clamping member is shifted generally horizontally and includes a stationary lower jaw and an adjustable upper jaw.

17. An apparatus as set forth in claim 1, wherein:

said lower roller is disposed adjacent to said table, such that the stack of sheet material is conveyed directly from said table to said lower roller.

18. An apparatus as set forth in claim 1, wherein:

said lower roller has an uppermost surface disposed generally level with an upper surface of said stack support member.

19. A method for separating and aerating sheets of material arranged in a stack, comprising:

positioning a stack of sheet material on a stack support member in a generally flat condition;

clamping an edge portion of the stack of sheet material to selectively retain the sheets in an aligned condition along the clamped edge;

conveying the clamped stack of sheet material generally horizontally between upper and lower nip rollers which compressingly engage the upper and lower surfaces of the stack therebetween; and positioning the upper and lower rollers in a staggered relationship such that an imaginary plane extending between the axes of rotation of the upper and lower rollers is disposed at an angle with respect to the direction in which the clamped stack is translated during said conveying step.

20. A method as set forth in claim 19, including:

shifting the stack of sheet material on said stack support member into a clamping member prior to said clamping step; and forming a separation between the clamping member and the stack support member, whereby the stack is placed on the lower roller, the stack is nipped between the upper roller and the lower roller in the area of the stack, and then the stack is pulled by the clamping member.

* * * * *

UNITED STATES PATENT AND TRADEMARK OFFICE

CERTIFICATE OF CORRECTION

PATENT NO. : 7,810,801 B2
APPLICATION NO. : 11/999563
DATED : October 12, 2010
INVENTOR(S) : Frank Stemmer It is certified that error appears in the above-identified patent and that said Letters Patent is hereby corrected as shown below:

Column 1, line 46, “stack that is” should be --stack is--.

Signed and Sealed this
Tenth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,810,801 B2
APPLICATION NO. : 11/999563
DATED : October 12, 2010
INVENTOR(S) : Frank Stemmer It is certified that error appears in the above-identified patent and that said Letters Patent is hereby corrected as shown below:

Title Page, Item (73) Assignee:

Add --Adolf Mohr Maschinenfabrik GmbH & Co. KG--

Signed and Sealed this
Fourth Day of October, 2011

David J. Kappos

David J. Kappos
*Director of the United States Patent and Trademark Office*